US006192907B1

(12) United States Patent
Wu

(10) Patent No.: US 6,192,907 B1
(45) Date of Patent: Feb. 27, 2001

(54) ERGONOMIC SAFETY RUNNER FOR UMBRELLA

(76) Inventor: Tsun-Zong Wu, 8F, No. 76, Lane 103, Nei-Hu Road, Sec. 2, Taipei (TW)

( * ) Notice: Subject to any disclaimer, the term of this patent is extended or adjusted under 35 U.S.C. 154(b) by 0 days.

(21) Appl. No.: 09/303,384

(22) Filed: May 1, 1999

(51) Int. Cl.[7] ..... A45B 25/06
(52) U.S. Cl. ..... 135/28; 135/41
(58) Field of Search ..... 135/28, 41, 40, 135/39, 38

(56) References Cited

U.S. PATENT DOCUMENTS

| | | | | |
|---|---|---|---|---|
| 183,982 | * | 10/1876 | Smith . | |
| 5,531,237 | * | 7/1996 | Yang | 135/28 |
| 5,566,699 | * | 10/1996 | Kou | 135/28 |
| 5,588,455 | * | 12/1996 | Kuo | 135/28 |
| 5,615,698 | * | 4/1997 | Ko | 135/28 |
| 5,732,725 | * | 3/1998 | Ko | 135/28 |
| 5,911,233 | * | 6/1999 | Wu | 135/28 |
| 5,964,235 | * | 10/1999 | Wang | 135/28 |
| 6,006,771 | * | 12/1999 | Wu | 135/41 |

FOREIGN PATENT DOCUMENTS

| | | | | |
|---|---|---|---|---|
| 1515169 | * | 1/1967 | (FR) | 135/28 |
| 493867 | * | 1/1967 | (EP) | 135/28 |

* cited by examiner

*Primary Examiner*—Robert Canfield

(57) ABSTRACT

A safety umbrella runner includes: a ferrule adapted for winding a fastening wire thereon for pivotally connecting umbrella stretcher ribs on the wire, and circumferentially formed on a runner tube slidably held on a central shaft of the umbrella; a safety tab resiliently secured to a lower rim of the runner tube having a lower convex portion protruding outwardly from the safety tab adapted for a depression of a user's finger for an ergonomic downward pulling of the runner when closing and folding the umbrella; a visor extension integrally formed on the ferrule and positioned above the safety tab to be upwardly pushed by the user's finger for opening the umbrella; and a clamp portion integrally formed on the runner tube and positioned above the visor extension, whereby upon laying-down of a lever-like tool on the visor extension and upon an upward bending of the wire ends of the fastening wire by biasing the lever-like tool against the visor extension, the wire ends of the fastening wire will be easily embedded into the clamp portion for safely concealing the wire ends of the fastening wire into the clamp portion of the runner.

2 Claims, 5 Drawing Sheets

ERGONOMIC SAFETY RUNNER FOR UMBRELLA

BACKGROUND OF THE INVENTION

U.S. Pat. No. 183,982 entitled "Umbrella Tip-Cups" to O. M. Smith disclosed a spring plate (g) resiliently secured to a slide member (D) having a cup (f) formed on an upper portion of the slide member (D), with the spring plate (g) operatively depressing a spring catch (a) for unlocking the slide member on the umbrella stick (A). The cup (f) seems to be an enlarged "holding portion" adapted for an upward pushing by a user's hand. However, this prior art still lacks of a finger-holding portion for downwardly moving the slide member (D) when closing the umbrella by inwardly depressing the spring catch (a) by depressing the spring plate (g), thereby influencing a smooth downward movement of the slide (D) when closing and folding the umbrella.

U.S. Pat. No. 5,566,699 entitled "Safety Runner for Use in Umbrellas" to C. S. Kou disclosed a cap for covering wire ends of a fastening wire fastened on the runner. However, the acute wire ends protruded from the runner may still injure a worker when assembling the cap on the ferrule of the runner.

U.S. Pat. No. 5,531,237 entitled "Shelter Means on Umbrella Ferrules for Concealing Wire Ends of Rib-fastening Wire" to C. K. Yang disclosed a shelter device having a sheath portion formed with a tubular hole for concealing the wire ends of the fastening wire on the runner into the hole of the sheath portion. However, it is very difficult to open the elongate sheath portion in order to embed the wire ends into the tubular hole of the sheath portion, thereby decreasing the production efficiency whenever concealing the wire ends of the rib-fastening wire into the shelter device of the umbrella runner.

The present inventor has found the drawbacks of the conventional umbrella runner, and invented the present ergonomic safety runner for umbrella.

SUMMARY OF THE INVENTION

The object of the present invention is to provide a safety umbrella runner including: a ferrule adapted for winding a fastening wire thereon for pivotally connecting umbrella stretcher ribs on the wire, and circumferentially formed on a runner tube slidably held on a central shaft of the umbrella; a safety tab resiliently secured to a lower rim of the runner tube having a lower convex portion protruding outwardly from the safety tab adapted for a depression of a user's finger for an ergonomic downward pulling of the runner when closing and folding the umbrella; a visor extension integrally formed on the ferrule and positioned above the safety tab to be upwardly pushed by the user's finger for opening the umbrella; and a clamp portion integrally formed on the runner tube and positioned above the visor extension, whereby upon laying-down of a lever-like tool on the visor extension and upon an upward bending of the wire ends of the fastening wire by biasing the lever-like tool against the visor extension, the wire ends of the fastening wire will be easily embedded into the clamp portion for safely concealing the wire ends of the fastening wire into the clamp portion of the runner.

DETAILED DESCRIPTION

Figure 5:
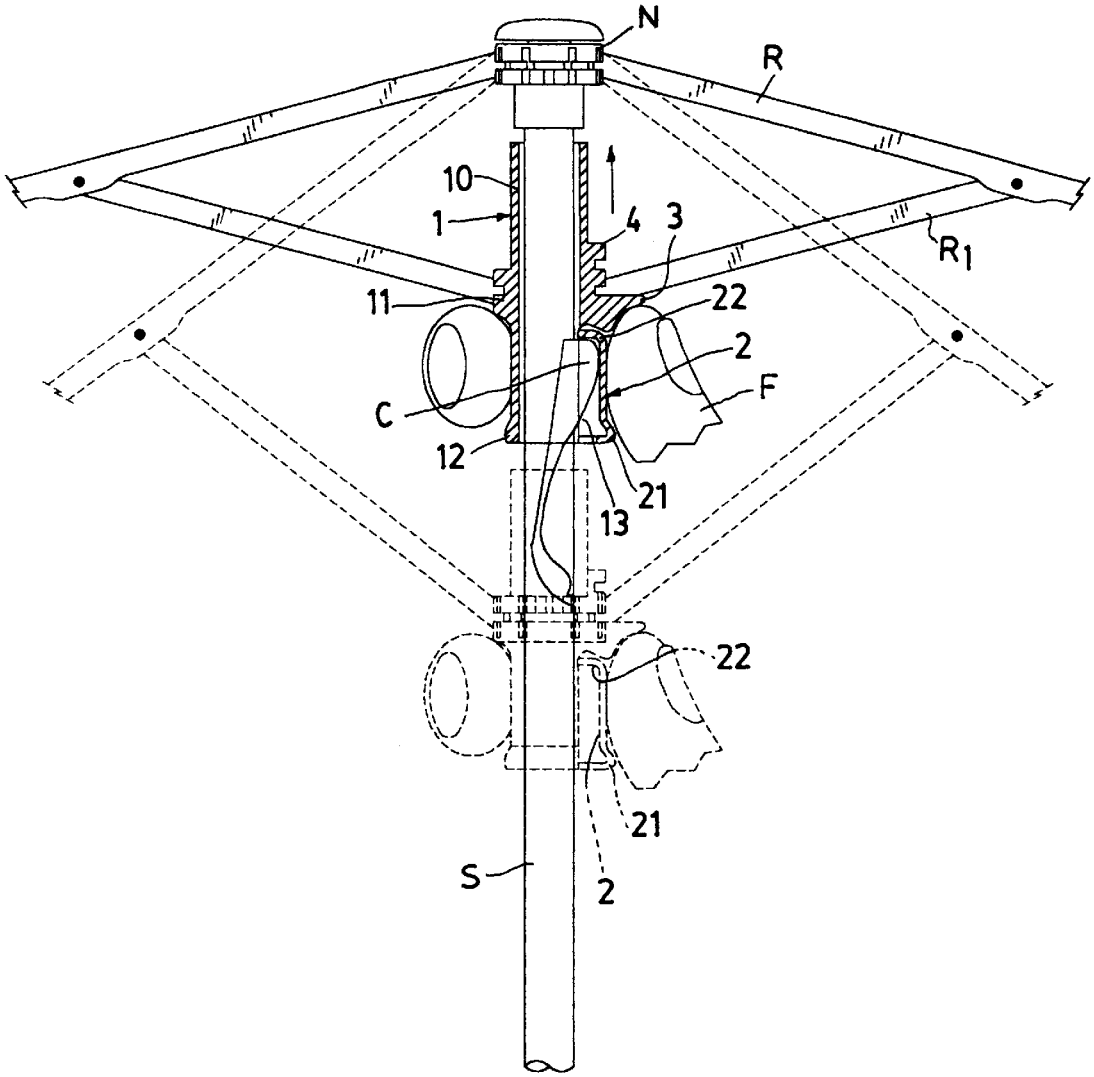
FIG. 5 is an illustration showing an umbrella opening operation of the present invention.

As shown in FIGS. 1~6, the safety runner for umbrella of the present invention comprises: a runner tube 10 slidably held on a central shaft S of the umbrella having a top rib R pivotally secured to an upper notch N formed on a top of the shaft S, a stretcher rib R1 pivotally connected between the top rib R and a ferrule 11 circumferentially formed on the runner tube 10 of the present invention having a spring catch C resiliently formed in the central shaft S for retaining the runner of the present invention at an opening state when opening the umbrella as shown in FIG. 5; a safety tab 2 resiliently secured to a lower rim 12 of the runner tube 10 having a catch hole 13 formed in the lower portion of the tube 10 for protruding the spring catch C outwardly for retaining the umbrella runner on the catch C when the umbrella is opened as shown in FIG. 5; a visor extension 3 integrally formed on the runner and protruded outwardly from the ferrule 11 of the runner above the safety tab 2; and a clamp portion 4 integrally formed on the tube 10 and positioned above the visor extension 3 for concealing the wire ends K of the fastening wire W wound on the ferrule 11 for pivotally connecting the stretcher ribs R1 on the wire W for preventing pricking of a user's finger F or hand when opening or closing the umbrella.

Figure 6:
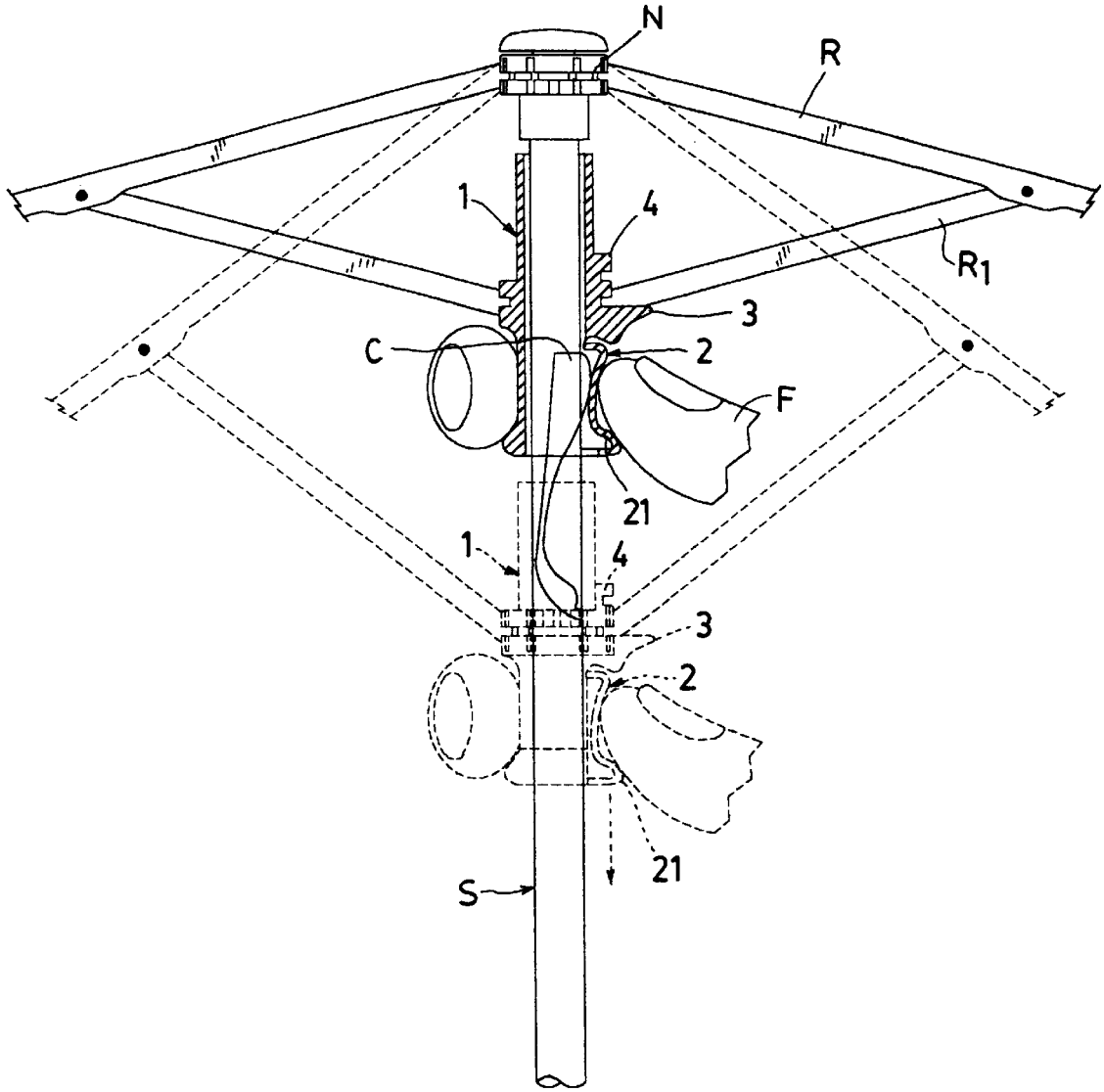
FIG. 6 shows a closing operation when folding the umbrella of the present invention.

The safety tab 2 includes: a lower convex portion 21 protruding outwardly from the lower rim 12 of the runner 1 to serve as a "lower handle" for pulling the convex portion of the runner 1 downwardly by depressing the convex portion 21 as shown in FIG. 6 for closing the umbrella; and an upper bending portion 22 bent inwardly to protect the spring catch C held in the shaft.

The visor extension 3 includes a concave portion 31 arcuately recessed inwardly in a lower portion of the visor extension towards a longitudinal axis X to serve as an "upper handle" for pushing the visor extension 3 of the runner upwardly for opening the umbrella as shown in FIG. 5 without falsely depressing the tab 2 and the catch C. Otherwise, when the tab 2 is falsely depressed to retard the outward protruding of the spring catch C, the spring catch C would not be resiliently protruded outwardly, unable for retaining the runner for stably opening the umbrella. So, the visor extension 3 of the present invention is very important for ergonomically opening the umbrella, while not falsely depressing and retarding the spring catch C which is provided to stably retain the runner for an opening umbrella.

Figure 1:
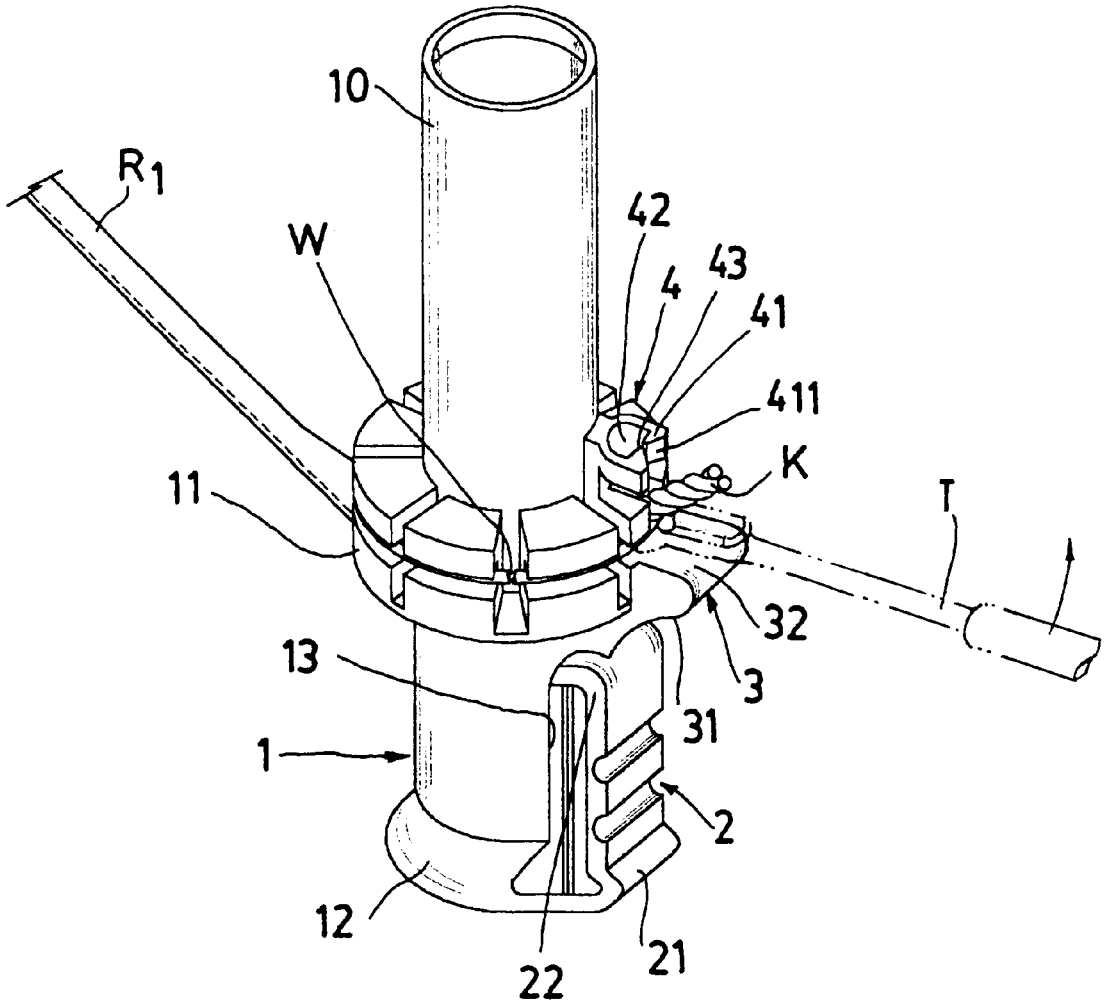
FIG. 1 is an illustration showing an embedding and concealing of the wire ends of a fastening wire into the clamp portion of the umbrella runner of the present invention.
Figure 2:
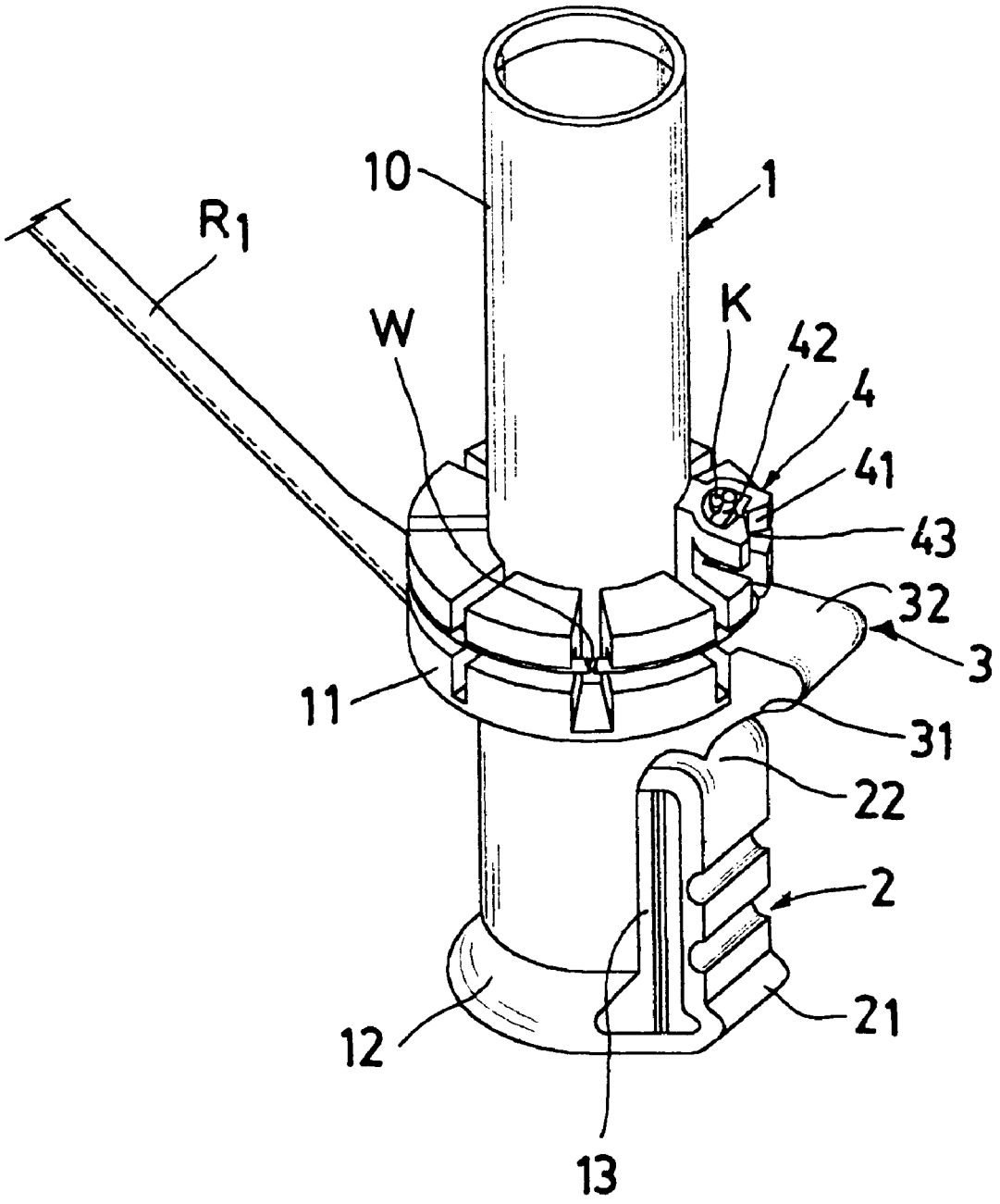
FIG. 2 is a perspective view of the runner of the present invention as assembled.
Figure 4:
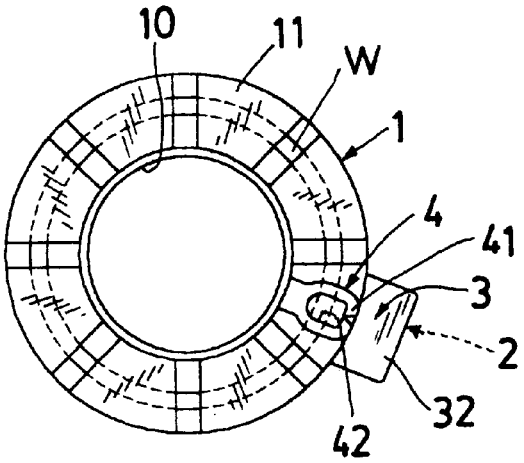
FIG. 4 is a top view of the runner of the present invention.
Figure 3:
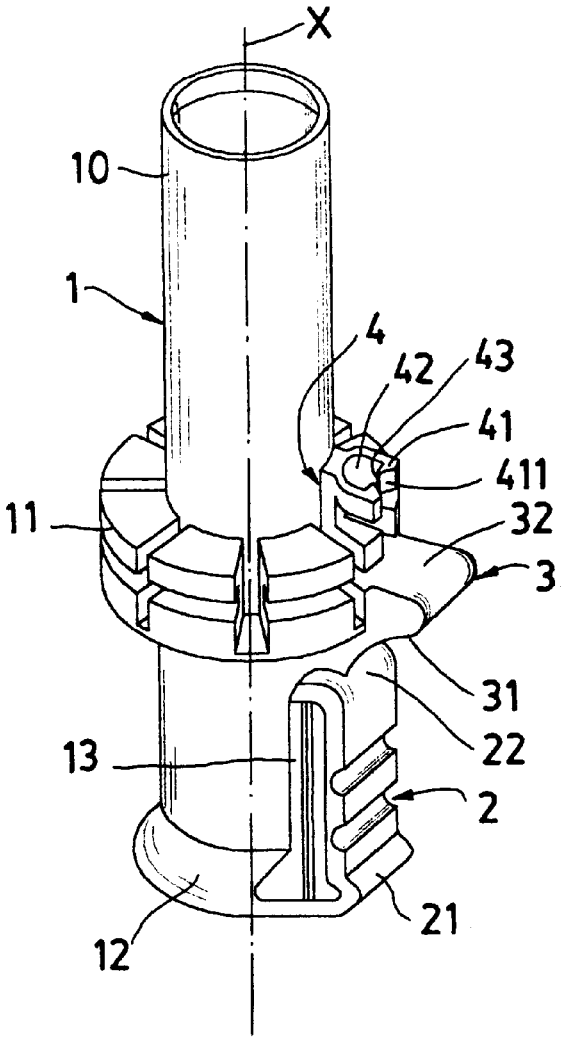
FIG. 3 is an illustration of the runner before being fastened with the fastening wire.

The visor extension 3 further includes a platform portion 32 on an upper surface portion of the visor extension to serve as a "working surface" as shown in FIG. 1 for laying down the lever-like tool T on the platform 32, on which the tool T is then biased upwardly in order for upwardly biasing the wire ends K of the fastening wire W wound on the ferrule 11 of the runner 1 for smoothly embedding the wire ends K into the clamp portion 4 of the runner of the present invention.

The clamp portion 4 includes: a pair of clamping members 41 integrally formed on the runner tube 10 and positioned above the visor extension 3, a longitudinal slit 43 defined between the two clamping members 41 for directing the wire ends K of the fastening wire W into a wire hole 42 formed in and surrounded by the two clamping members 41 for storing the wire ends K in the wire hole 42 for preventing a pricking injury to an umbrella user or a worker when assembling the umbrella.

Each clamping member 41 of the clamp portion 4 has a sloping surface 411 formed on the front surface of the clamping member 41 and tapered inwardly towards the longitudinal slit 43 between the two clamping members 41 for smoothly guiding the wire ends K into the wire hole 42 through the sloping surface 411 formed on each clamping member 41.

The present invention is superior to a conventional umbrella runner with the following advantages:

1. The safety tab provides a lower convex portion for a downward pulling of the runner for closing the umbrella; and also having a visor extension for upward pushing of the runner for opening the umbrella. The umbrella can be closed and opened safely and ergonomically.
2. The visor extension plays double roles both for ergonomically pushing the runner upwardly for opening he umbrella and for serving as a working platform when biasing a lever-like tool laid on the platform for upwardly bending the wire ends of the fastening wire in order to be smoothly led into the hole in the clamp portion formed on the runner.
3. The clamp portion provides the pair of clamping members which will be easily opened due to their elasticity to smoothly guide the wire ends into the hole in the clamp portion, and the two clamping members will then be resiliently restored to "close" the hole of the clamp portion for safely storing the wire ends within the clamp portion.

The present invention may be further modified without departing from the spirit and scope of the present invention.

I claim:

1. A safety umbrella runner comprising:

a runner tube slidably engageable on a central shaft of an umbrella having a plurality of top ribs pivotally secured to an upper notch on a top of the shaft and a plurality of stretcher ribs each pivotally connected between each top rib and a ferrule circumferentially formed on the runner tube;

a safety tab resiliently secured to a lower rim of said runner tube having a catch hole defined between the safety tab and the runner tube, and having a lower convex portion protruding outwardly from said lower rim adapted for an ergonomic downward pulling of the convex portion, when depressing the tab for disengaging a safety catch which is resiliently held in said shaft for retaining the runner when the umbrella is opened, for lowering the runner for closing the umbrella; and a visor extension integrally secured to the ferrule and positioned above said safety tab, the improvement which comprises: said visor extension having a concave portion recessed in a lower portion of the visor extension adapted for an upward pushing of said visor extension for smoothly opening the umbrella for preventing a false depression on the safety tab, and having a platform portion formed on an upper surface portion of the visor extension adapted for laying down a lever-like tool on the platform, on which the tool is biased upwardly for upwardly bending two wire ends of a fastening wire, which is wound on the ferrule for pivotally securing the stretcher ribs on said wire on the ferrule in order to embed the wire ends into a clamp portion integrally formed on the runner tube.

2. A safety umbrella runner according to claim 1, wherein said clamp portion on said runner tube includes a pair of clamping members integrally secured to the runner tube, and a longitudinal slit defined between said two clamping members for smoothly guiding the wire ends into a wire hole formed within the two clamping members when the wire ends are biased upwardly by the tool and are inwardly embedded into the wire hole as urged by the tool.

* * * * *